US009498684B2

(12) United States Patent
Motokawa

(10) Patent No.: US 9,498,684 B2
(45) Date of Patent: Nov. 22, 2016

(54) GOLF CLUB HEAD

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

(21) Appl. No.: 14/843,348

(22) Filed: Sep. 2, 2015

(65) Prior Publication Data

US 2016/0059091 A1 Mar. 3, 2016

(30) Foreign Application Priority Data

Sep. 3, 2014 (JP) ..... 2014-179050

(51) Int. Cl.
*A63B 53/04* (2015.01)

(52) U.S. Cl.
CPC ..... *A63B 53/0466* (2013.01); *A63B 53/04* (2013.01); *A63B 2053/045* (2013.01)

(58) Field of Classification Search
CPC ..... A63B 53/0466; A63B 53/04; A63B 2053/045; A63B 2053/0454
See application file for complete search history.

(56) References Cited

U.S. PATENT DOCUMENTS

| | | | | |
|---|---|---|---|---|
| 5,908,356 | A * | 6/1999 | Nagamoto | A63B 53/04 473/224 |
| 5,941,782 | A * | 8/1999 | Cook | A63B 53/04 473/346 |
| 6,852,038 | B2 * | 2/2005 | Yabu | A63B 53/04 473/224 |
| 2002/0022535 | A1 * | 2/2002 | Takeda | A63B 53/04 473/346 |
| 2010/0048324 | A1 * | 2/2010 | Wada | A63B 53/0466 473/346 |
| 2011/0152001 | A1 * | 6/2011 | Hirano | A63B 53/0466 473/337 |
| 2011/0312437 | A1 * | 12/2011 | Sargent | A63B 53/02 473/335 |
| 2012/0142450 | A1 * | 6/2012 | Wada | A63B 53/0466 473/345 |
| 2013/0109503 | A1 * | 5/2013 | Matsunaga | A63B 53/00 473/346 |

FOREIGN PATENT DOCUMENTS

| | | |
|---|---|---|
| JP | 10-024128 A | 1/1998 |
| JP | 2002-186691 A | 7/2002 |
| JP | 2009-233266 A | 10/2009 |

* cited by examiner

*Primary Examiner* — John E Simms, Jr.
(74) *Attorney, Agent, or Firm* — Birch, Stewart, Kolasch & Birch, LLP

(57) ABSTRACT

Provided is a golf club head having a reduced weight while also preventing degradation in the ball hitting sound. The golf club head includes a head body that is a hollow structure, and a rib that rises from an inner surface of the head body. An opening having a non-circular shape is formed in a side surface of the rib. Note that the opening referred to here may be a through-hole or an opening that has a bottom.

16 Claims, 12 Drawing Sheets

E1 cross-section

GOLF CLUB HEAD

CROSS REFERENCE TO RELATED APPLICATIONS

This application claims a priority to Japanese Patent Application No. 2014-179050 filed on Sep. 3, 2014, which is hereby incorporated by reference in its entirety.

FIELD OF INVENTION

The present invention relates to a golf club head.

BACKGROUND

There are many golf club heads in which the head body forms a hollow structure. In recent years, the wall thickness of the head body of this type of golf club head has been progressively reduced for the purpose of reducing the weight of the golf club head. However, this reduction in wall thickness reduces the rigidity of the golf club head, and a reduction in rigidity tends to lead to the problem of a low and dull ball hitting sound that is generally unfavorable.

In view of this, there are cases where a rib is formed on an inner surface of the head body in order to solve the above problem (see Patent Literatures JP H10-24128A, JP 2002-186691A and JP 2009-233266A). This rib effectively improves the rigidity of the golf club head, which had been reduced by the reduction in the wall thickness of the head body, thus making it possible to increase the natural frequency of the golf club head. As a result, a reduction in wall thickness is achieved, and a high and pleasant-sounding ball hitting sound is also obtained.

SUMMARY OF INVENTION

However, if a rib is formed in order to improve the ball hitting sound, the weight increases due to the rib, and there are cases where this results in not being able to sufficiently reduce the weight of the golf club head.

An object of the present invention is to provide a golf club head that has a reduced weight while also preventing degradation in the ball hitting sound. Note that the reduction in the weight of the golf club head referred to here includes not only an absolute reduction in the weight of the golf club head, but also ensuring a larger amount of weight (hereinafter referred to as "free weight") that can be freely used to attain various design goals. The free weight referred to here means weight other than the minimum weight required to form the head. The larger the free weight, the higher the degree of freedom for design of the golf club head. The free weight can be used to adjust the position of the center of gravity of the golf club head, the moment of inertia of the golf club head, or the like. Accordingly, if the free weight is allocated to various places in the golf club head, the overall weight of the golf club head does not change, and even in this case, as long as the weight of the golf club head is reduced in a portion other than the portions to which the free weight is allocated, the weight of the golf club can be considered to have been reduced. Similarly, the phrase "increase in weight" or a similar phrase can mean being able to ensure only a smaller amount of free weight.

A golf club head according to a first aspect of the present invention includes a head body that is a hollow structure, and a rib that rises from an inner surface of the head body. An opening having a non-circular shape is formed in a side surface of the rib. Note that the opening referred to here may be a through-hole or an opening that has a bottom.

A golf club head according to a second aspect of the present invention is the golf club head according to the first aspect, wherein the opening has a polygonal shape. Note that the polygonal shape referred to here is a concept that includes an approximate polygonal shape, and also includes a shape in which at least one corner and/or at least one side is curved.

A golf club head according to a third aspect of the present invention is the golf club head according to the second aspect, wherein the opening has a triangular shape. Note that the triangular shape referred to here is a concept that includes an approximate triangular shape, and also includes a shape in which at least one corner and/or at least one side is curved.

A golf club head according to a fourth aspect of the present invention is the golf club head according to any of the first to third aspects, wherein a plurality of openings are formed in the side surface of the rib.

A golf club head according to a fifth aspect of the present invention is the golf club head according to the third or fourth aspect, wherein a plurality of openings having a triangular shape are formed in the side surface of the rib, the plurality of openings being aligned in a mode in which the rib at least partially forms a truss structure.

A golf club head according to a sixth aspect of the present invention is the golf club head according to any of the first to fifth aspects, wherein the rib and at least a portion of the head body are formed integrally.

A golf club head according to a seventh aspect of the present invention is the golf club head according to any of the first to fifth aspects, wherein the rib is manufactured separately from the head body and thereafter fixedly attached to at least a portion of the head body.

A golf club head according to an eighth aspect of the present invention is the golf club head according to any of the first to seventh aspects, wherein the volume occupied by the opening is in a range of 10% to 70% of the volume occupied by the rib.

A golf club head according to a ninth aspect of the present invention is the golf club head according to any of the first to eighth aspects, wherein the head body has a sole portion. The rib is formed on at least an inner surface of the sole portion.

A golf club head according to a tenth aspect of the present invention is the golf club head according to any of the first to ninth aspects, wherein the head body has a crown portion. The rib is formed on at least an inner surface of the crown portion.

A golf club head according to an eleventh aspect of the present invention is the golf club head according to any of the first to tenth aspects, wherein the head body has a face portion. The rib is formed on at least an inner surface of the face portion.

A golf club head according to a twelfth aspect of the present invention is the golf club head according to any of the first to eleventh aspects, wherein the inner surface of the head body has a first surface and a second surface that oppose each other. The rib extends from the first surface to the second surface without traversing a surface of the inner surface other than the first surface and the second surface.

A golf club head according to a thirteenth aspect of the present invention is the golf club head according to any of the first to twelfth aspects, wherein the opening is formed on the side surface of the rib in a vicinity of a node of vibration of the head body.

A golf club head according to a fourteenth aspect of the present invention is the golf club head according to any of the first to thirteenth aspects, wherein the golf club head is a driver.

A golf club head according to a fifteenth aspect of the present invention includes a head body that is a hollow structure, and a rib that rises from an inner surface of the head body. An opening is formed in a side surface of the rib.

According to the present invention, a rib is formed on an inner surface of a head body that has a hollow structure, and an opening is formed in a side surface of the rib. As a result, the rigidity of a golf club head is improved by the rib, and an increase in the weight of the club head is suppressed by the opening formed in the side surface of the rib. Furthermore, it is possible to efficiently improve the rigidity of the rib relative to the weight of the rib (hereinafter, called the specific rigidity of the rib). Accordingly, it is possible to effectively suppress a reduction in the rigidity of the golf club head, and the weight of the golf club head is reduced while also preventing degradation in the ball hitting sound.

In particular, if the opening in the rib is formed having a polygonal shape as in the second aspect, the specific rigidity of the rib can be improved more efficiently. Also, if multiple openings having a triangular shape are formed, and the rib at least partially has a truss structure as in the fifth aspect, the specific rigidity of the rib can be improved even more efficiently.

DETAILED DESCRIPTION OF THE PREFERRED EMBODIMENTS

A golf club head according to an embodiment of the present invention will be described below with reference to the drawings.

1. Overall Configuration of Golf Club Head

Figure 1:
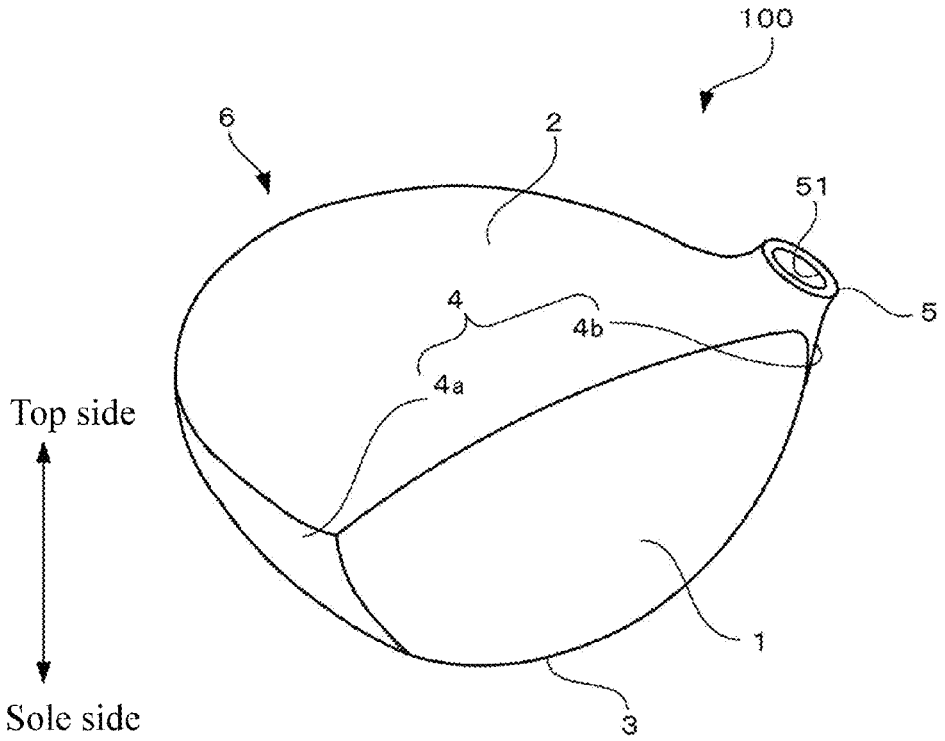
FIG. 1 is a perspective view of a golf club head in a reference state.
Figure 2:
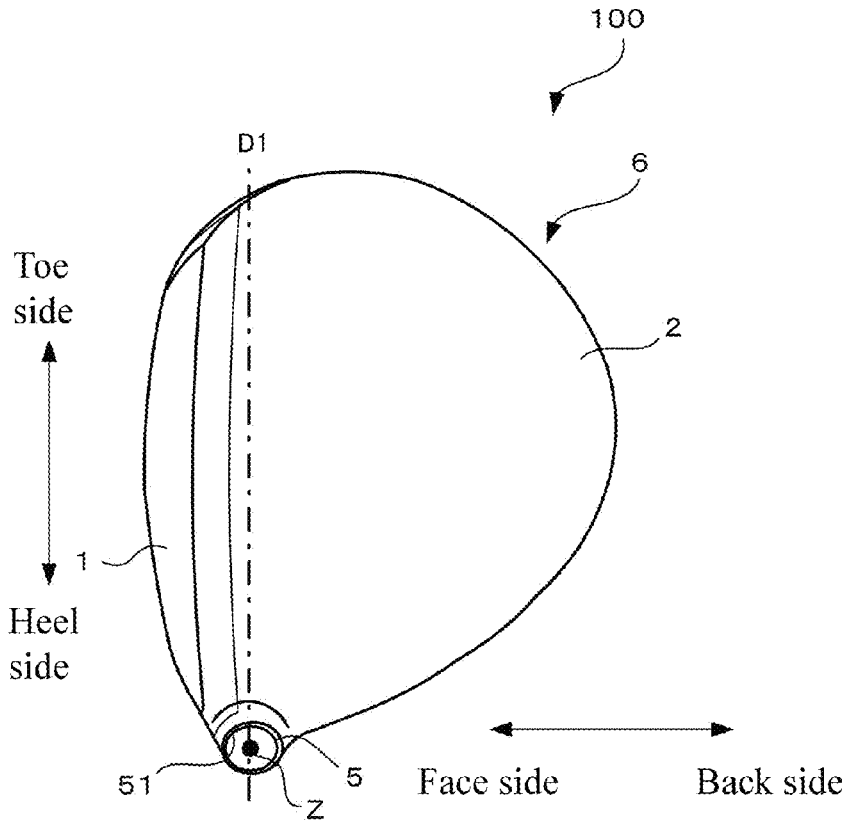
FIG. 2 is a plan view of the golf club head in the reference state.

FIG. 1 is a perspective view of a golf club head (hereinafter sometimes simply referred to as the "head") 100 of the present embodiment in a reference state, and FIG. 2 is a plan view of the head 100 in the reference state. Note that the reference state of the golf club head 100 will be described later. The head 100 has a head body 6 that is a hollow structure, and the head body 6 has wall surfaces formed by a face portion 1, a crown portion 2, a sole portion 3, a side portion 4, and a hosel portion 5 that are continuous with each other. Although the head 100 is a wood-type head such as a driver (#1) or fairway wood, there are no limitations on the type of the golf club head to which a later-described rib 7 having openings S1 can be applied, and as long as the head body is a hollow structure, the head 100 may be a so-called utility-type head, a hybrid-type head, or the like, or may be an iron-type head.

The face portion 1 has a face surface for hitting a ball, and constitutes a front portion of the head 100. The face surface is approximately flat. The crown portion 2 is adjacent to the face portion 1, and constitutes the upper surface of the head 100. The sole portion 3 constitutes the bottom surface of the head 100, and is adjacent to the face portion 1 and the side portion 4. Also, the side portion 4 is the portion between the crown portion 2 and the sole portion 3, and extends from the toe side of the face portion 1, across the back side of the head 100, to the heel side of the face portion 1. In particular, the toe-side portion of the side portion 4 will be referred to as a side portion 4*a*, and the heel-side portion of the side portion 4 will be referred to as a side portion 4*b*. Furthermore, the hosel portion 5 is the portion provided adjacent to the heel side of the crown portion 2, and has an insertion hole 51 for the insertion of the shaft (not shown) of the golf club.

The following describes the aforementioned reference state. As shown in FIGS. 1 and 2, the reference state is defined as a state in which a central axis Z of the insertion hole 51 is included in a plane D1 that is perpendicular to a horizontal plane H (hereinafter, referred to as the "reference vertical plane D1"), and furthermore the head 100 is placed on the horizontal plane H at a predetermined lie angle and hook angle. Also, as shown in FIG. 2, the direction of the line of intersection of the reference vertical plane D1 and the horizontal plane H will be referred to as the toe-heel direction, and the direction that is perpendicular to the toe-heel direction and parallel to the horizontal plane H will be referred to as the face-back direction. Also, the direction perpendicular to the horizontal plane H will be referred to as the top-sole direction.

Figure 3A:
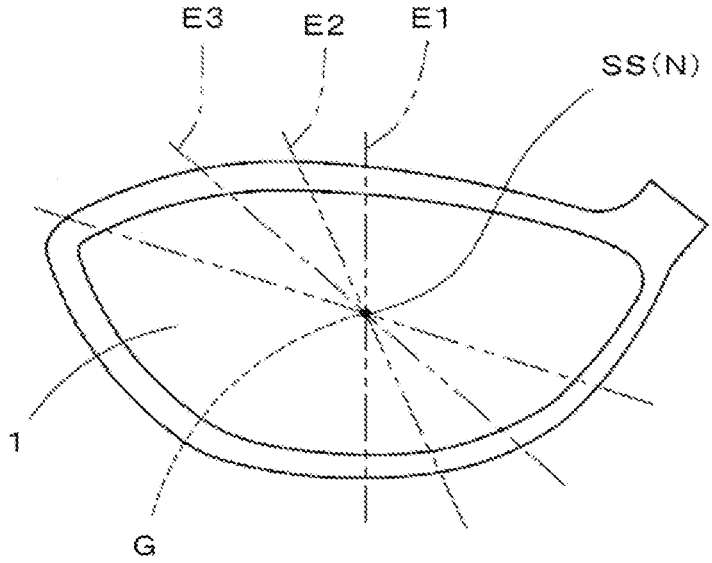
FIGS. 3A and 3B are diagrams for describing the boundary of a face portion.
Figure 3B:
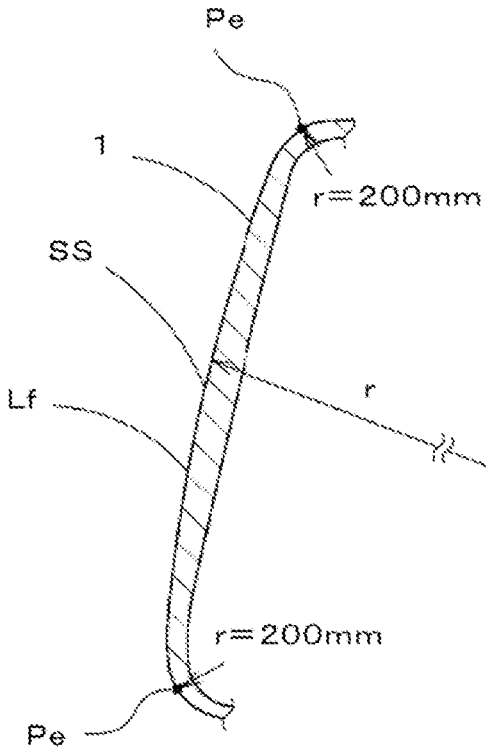

In the present embodiment, the boundary between the crown portion 2 and the side portion 4 can be defined as follows. Specifically, if a ridge line is formed between the crown portion 2 and the side portion 4, that ridge line serves as the boundary. On the other hand, if a clear ridge line is not formed, the boundary is the outline that is seen when the head 100 is placed in the reference state and viewed from directly above a center of gravity G of the head 100. Similarly, in the case of the boundaries between the face portion 1 and the crown portion 2 and between the face portion 1 and the sole portion 3 as well, if a ridge line is formed, that ridge line serves as the boundary. However, if a clear ridge line is not formed, the peripheral edge (boundary) of the face portion 1 is defined by positions Pe where, in cross-sections E1, E2, E3, and so on that include a straight line N connecting the head center of gravity G and a sweet spot SS as shown in FIG. 3A, a radius of curvature r of an outline Lf of the outer surface of the face first reaches 200 mm when extending outward from the sweet spot side as shown in FIG. 3B. Note that the sweet spot SS is the intersection of the face surface (that is the outer surface of the face portion 1) and a line that passes through the center of gravity G of the golf club head 100 and is perpendicular to the face surface.

It is preferable that the volume of the golf club head 100 is 70 $cm^3$ or more, for example. If the golf club head 100 is a driver, the volume is preferably 300 $cm^3$ or more, more preferably 400 $cm^3$ or more, and particularly preferably 420 $cm^3$ or more. Having such a volume is advantageous for the head in terms of increasing comfort when the club is held and also increasing the sweet spot area and the moment of inertia. Note that although an upper limit is not particularly defined for the head volume, practically it is, for example, desirably 500 $cm^3$ or less, or desirably 470 $cm^3$ or less when complying with R&A or USGA rules and regulations.

The head body 6 can be formed from, for example, a titanium alloy having a specific gravity of approximately 4.0 to 5.0 (e.g., Ti-6Al-4V). Besides a titanium alloy, the head can be formed from one or two or more materials selected from among stainless steel, maraging steel, an aluminum alloy, a magnesium alloy, an amorphous alloy, and the like. Also, there is no limitation to a metal material, and the head can also be formed using a fiber-reinforced plastic or the like. The same follows for the material making up the later-described rib 7 as well. Note that the rib 7 and the head body 6 may be formed using the same material, or may be formed using different materials.

The head 100 of the present embodiment is constituted by assembling the face portion 1 with a body portion that has the crown portion 2, the sole portion 3, the side portion 4, and the hosel portion 5. The body portion and the face portion 1 are joined by welding (plasma welding, laser welding, brazing, etc.), for example. The body portion has an opening surrounded by the crown portion 2, the sole portion 3, and the side portion 4, and the face portion 1 is attached so as to block this opening. The body portion can also be an assembly of multiple parts, and can also be formed as a single body. The body portion and the face portion 1 can be produced using various methods. For example, the body portion can be manufactured by casting using a known lost-wax precision casting method or the like. Also, the face portion 1 can be manufactured using a forging method, flat plate press machining, or the like.

2. Structure of Rib

Figure 4:
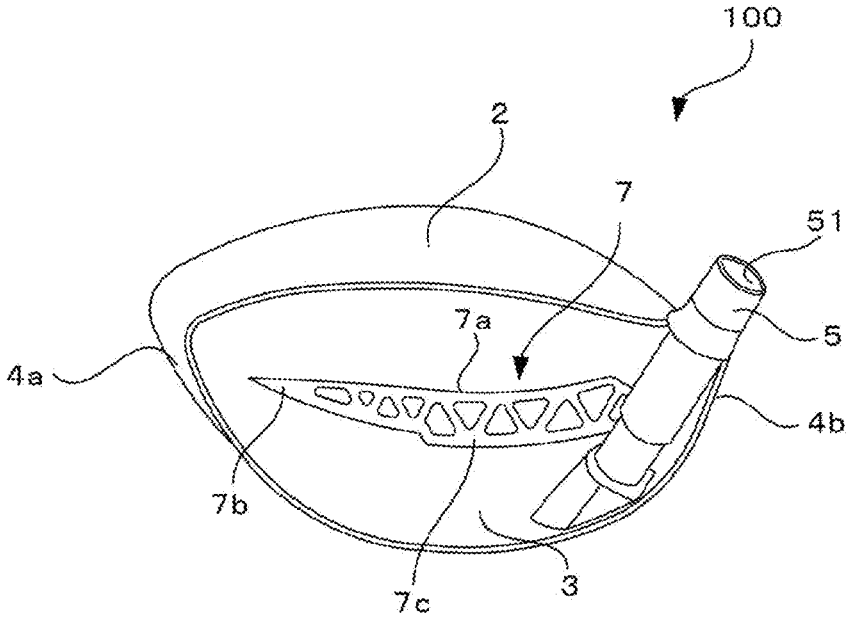
FIG. 4 is a diagram of the golf club head in a state in which the face portion has been removed, as viewed from the front side.
Figure 5:
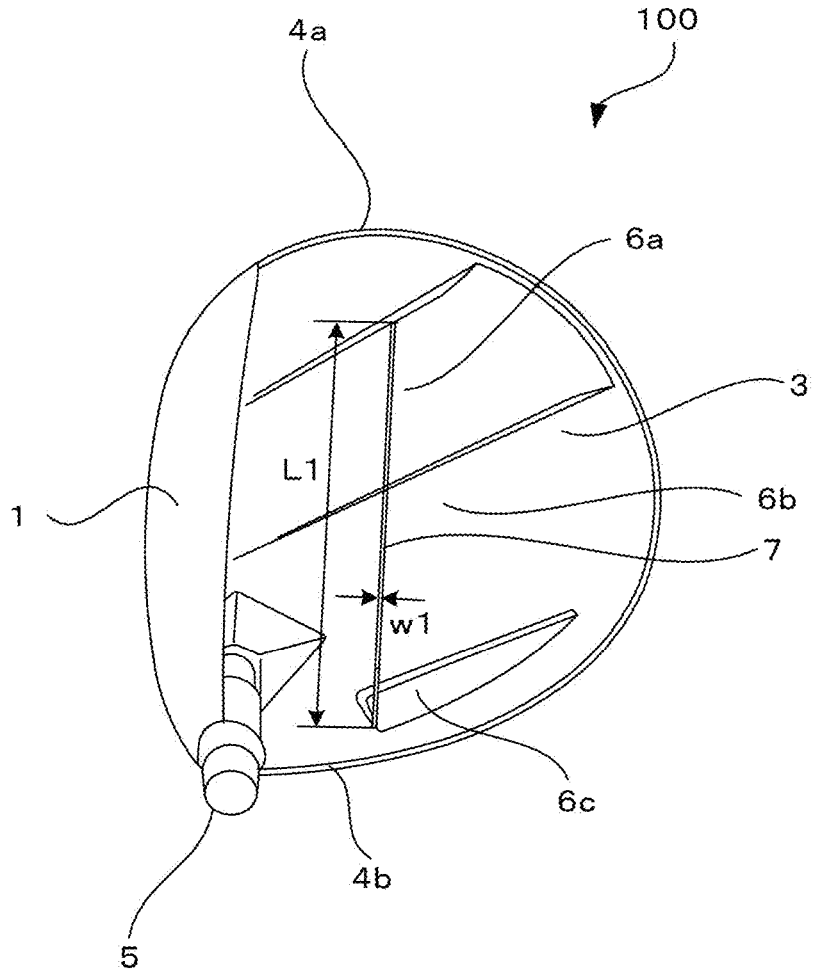
FIG. 5 is a diagram of the golf club head in a state in which a crown portion has been removed, as viewed from above.

FIG. 4 is a diagram of the head 100 in a state in which the face portion 1 has been removed, as viewed from the front side, and FIG. 5 is a diagram of the head 100 in a state in which a crown portion 2 has been removed, as viewed from above. FIGS. 4 and 5 show the interior space of the head body 6, and as shown in these figures, the rib 7 is formed on the inner surface of the sole portion 3. The rib 7 plays the roles of improving the rigidity of the head 100 and raising the natural frequency of the head 100, thus making it possible to obtain a high and pleasant ball hitting sound. In order to enhance the rigidity improving effect, the rib 7 of the present embodiment rises from the inner surface of the sole portion 3 so as to be approximately orthogonal to the inner surface, but it can be formed so as to be inclined to one side.

As shown in FIGS. 4 and 5, the rib 7 of the present embodiment extends approximately parallel to the face portion 1. Accordingly, the rib 7 can suppress mainly flexure in the toe-heel direction and can improve the rigidity in this direction. Also, the rib 7 of the present embodiment is a member having a thin plate shape, and has a thickness w1 that is approximately uniform along the lengthwise direction. The thickness w1 of the rib 7 can be appropriately set according to design conditions such as the rigidity value that is to be realized and the allowable weight of the rib 7 relative to the overall weight of the head 100, but preferably w1=0.5 mm to 3.0 mm, and more preferably w1=0.7 mm to 2.0 mm. If the thickness w1 of the rib 7 is low in this manner, it is possible to suppress an increase in weight caused by the rib 7, while also efficiently improving the rigidity of the head 100. Also, a length L1 of the rib 7 in the lengthwise direction can also be appropriately set according to design conditions, but can preferably be L1=80 mm to 130 mm, or more preferably be L1=90 mm to 120 mm, for example. The above numerical value range for L1 is particularly suited to the case where the volume of the head 100 is 400 $cm^3$ or more.

An upper end edge 7*a* of the rib 7 of the present embodiment is approximately parallel with the outer edge of the portion of the sole portion 3 from which the rib 7 rises, and is gently curved in an outwardly protruding shape. Also, the inner surface of the head body 6 has a thin portion 6*b* and thick portions 6*a* and 6*c* in which free weight has been allocated in order to realize a designed center of gravity position for the head 100, for example. For this reason, a height h1 of the rib 7 is generally higher in the thin portion 6*b* and lower in the thick portions 6*a* and 6*c*, but at the highest place can be h1=3 mm to 10 mm, or more preferably h1=4 mm to 8 mm, for example. Note that the height h1 of the rib 7 can also be appropriately set according to design conditions. Also, the shape of the rib 7 and h1 change according to not only the wall thickness of the sole portion 3, but also the extent of curvature of the sole portion 3.

Figure 6:
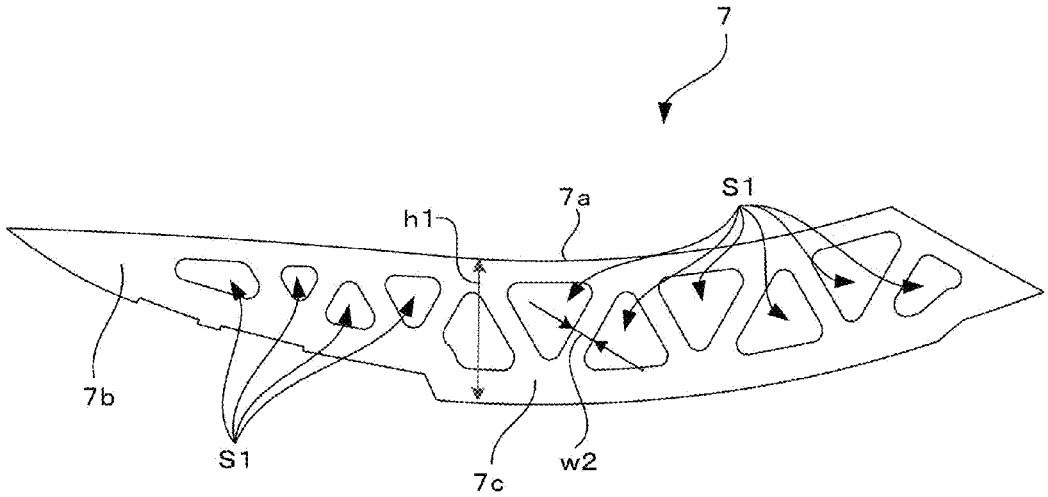
FIG. 6 is an enlarged view of a rib.

FIG. 6 is an enlarged view of the rib 7. As shown in FIG. 6, many openings S1 are formed in a side surface of the rib 7. As a result, reduction of the weight of the head 100 can be achieved without reducing the rigidity improving effect of the rib 7.

The openings S1 of the present embodiment are through-holes, and although there are some exceptions for the sake of the shape of the rib 7, the openings S1 mainly all have a triangular shape. Note that in the present embodiment, the openings S1 mainly all have an approximately equilateral triangular shape. Furthermore, in a portion 7*c* excluding an end portion 7*b* on the toe side of the rib 7, the openings S1 are aligned such that the sides of adjacent triangular shapes are approximately parallel with each other. Specifically, the rib 7 of the present embodiment forms a truss structure in which a gap w2 between adjacent openings S1 is approximately constant, and the truss structure is formed by connecting beams having the width w2. As a result, it is possible to efficiently realize a reduction in the weight of the head 100 without impairing the strength of the rib 7, and thus the rigidity improving effect of the rib 7.

The beam width w2 can also be appropriately set according to design conditions, but it can be w2=0.5 mm to 3.0 mm, or more preferably w2=0.7 mm to 2.0 mm, for example. Note that the width w2 can be set differently according to the location. In other words, the rib 7 can have a truss structure formed by a combination of beams that have different widths w2. Also, the width w2 may change within the same beam, and the outlines of a beam in the lengthwise direction do not need to be parallel with each other. Also, the ratio of the volume occupied by the openings S1 to the overall volume of the rib 7 can be appropriately set according to design conditions, but is 10% to 70%, or more preferably 20% to 50%, for example, The openings S1 formed in the rib 7 can be formed by first forming a member that is to be the rib 7 and does not have the openings S1 formed therein (as will be described later, if the rib 7 and at least a portion of the head body 6 are formed integrally, the aforementioned member is the integrated body for them), and then forming the openings S1 by performing a method such as cutting on the member. Alternatively, a rib 7 that originally has the openings S1 formed therein can be formed by casting or the like. Also, the rib 7 (including a rib having the openings S1 formed therein and a rib not having the openings S1 formed therein) can be integrally formed with at least a portion of the head body 6 (e.g., the above-described body portion), or can be first manufactured separately from the head body 6 and then fixedly attached to at least a portion of the head body 6 by welding or the like.

3. Variations

Although an embodiment of the present invention has been described above, the present invention is not limited to the above embodiment, and various modifications can be carried out without departing from the gist of the invention. The following are examples of modifications. Any combination of the features of the following variations can be used as appropriate.

3-1

The shape of the openings S1 formed in the rib 7 is not limited to the shape described above, and can be a polygonal shape other than a triangle, such as a quadrangle, a pentagon, etc. Also, even in the case of a triangle, there is no limitation to being an equilateral triangle, and the openings can be formed in any triangular shape. Note that from the viewpoint of giving the rib 7 a truss structure by aligning triangular openings S1, it is preferable that the openings S1 have an equilateral triangular shape, a rectangular triangular shape, an isosceles triangular shape, or the like. In the case of a quadrangle, it is preferable that the openings have a square shape, a rectangular shape, or a parallelogram shape. In other words, it is preferable that the shape of the openings S1 is a shape that allows the openings S1 to be easily arranged in a dense manner.

3-2

Figure 7:
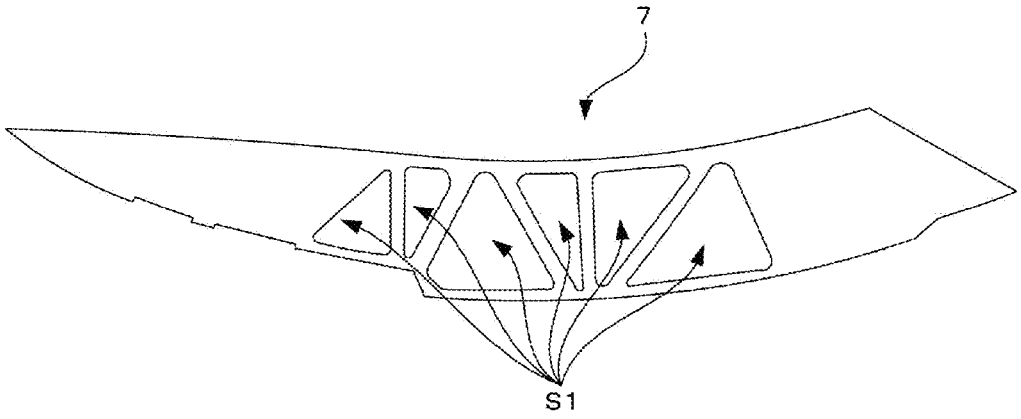
FIG. 7 is a diagram showing a rib according to a variation.
Figure 8:
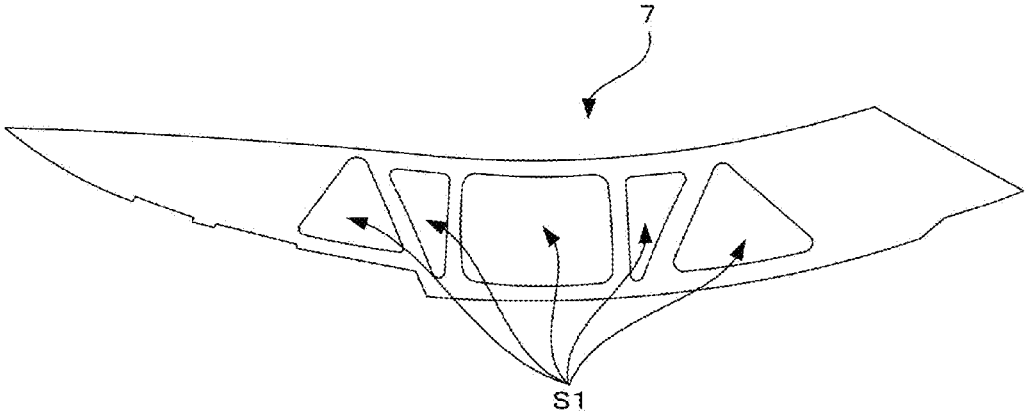
FIG. 8 is a diagram showing a rib according to another variation.
Figure 9:
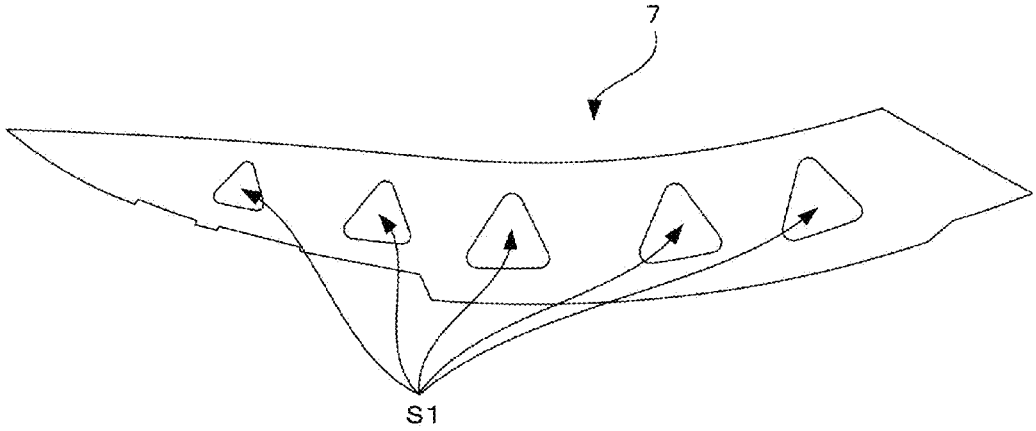
FIG. 9 is a diagram showing a rib according to yet another variation.

A configuration is possible in which only one opening S1 is formed in the rib 7. Also, in the case where multiple openings S1 are formed in the rib 7, there is no limitation to combining only openings S1 that have the same shape, and it is also possible to combine openings S1 that have different shapes. For example, as shown in FIG. 7, it is possible to combine openings S1 that have different triangular shapes, and as shown in FIG. 8, it is possible to combine triangular openings with a quadrangular opening S1, for example. Also, in the case where multiple triangular openings S1 are formed, as shown in FIG. 9 for example, the openings S1 can be aligned such that the rib 7 does not have a truss structure.

3-3

Multiple ribs 7 having openings S1 formed therein can be formed on an inner surface of the head body 6. Also, it is possible to form a combination of a rib 7 having openings S1 formed therein and a rib not having openings S1 formed therein.

3-4

Figure 10:
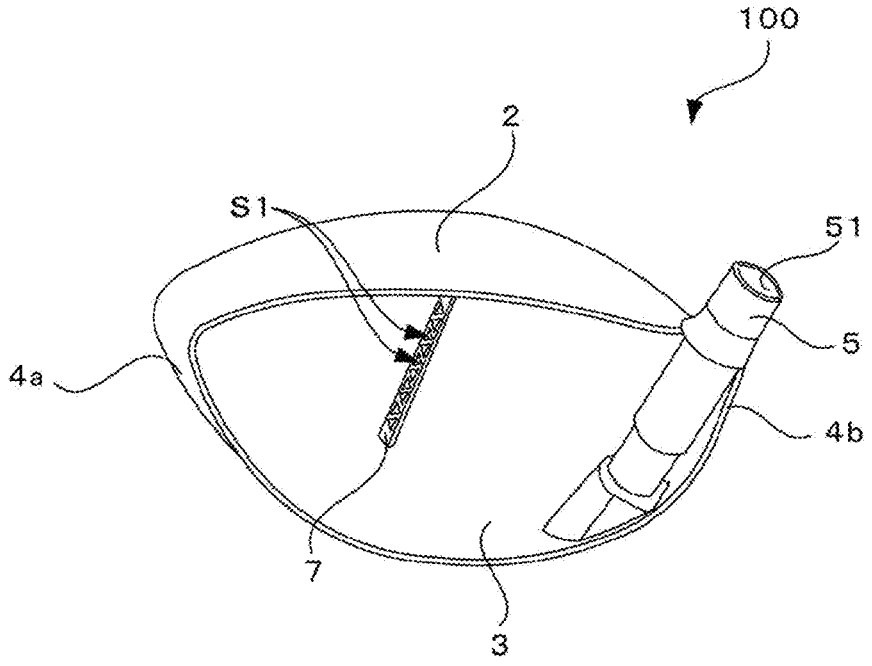
FIG. 10 is a diagram showing a golf club head according to still another variation, in a state in which the face portion has been removed.

The position at which the rib 7 is formed is not limited to the position described above. For example, the rib 7 may be formed on the inner surface of the crown portion 2, the side portion 4, or the face portion 1, and can be formed so as to cross the inner surfaces of two or more portions selected from among these portions 1, 2, and 4 and the sole portion 3. Also, it is possible to form a rib 7 that extends as a column between any two opposing surfaces that constitute the inner surface of the head body 6, and to form the openings S1 in such a rib 7. For example, as shown in FIG. 10, it is possible to form a rib 7 that extends as a column so as to connect the crown portion 2 to the sole portion 3 without traversing the side portion 4, and to form the openings S1 in such a rib 7.

Also, the direction in which the rib 7 extends is not limited to the direction described above. For example, it can be formed so as to extend in the toe-heel direction, it can be formed so as to extend in the face-back direction, it can be formed so as to extend in the top-sole direction, and it can be formed so as to extend at an angle with respect to two or more directions selected from among the toe-heel direction, the face-back direction, and the top-sole direction. Also, the rib 7 does not need to extend in a straight line along the lengthwise direction, and may be curved. Specifically, the rib 7 can be formed at a location on the inner surface of the head body 6 at which the rigidity is to be improved, in a direction in which the rigidity is to be improved, and in any mode.

3-5

Figure 11:
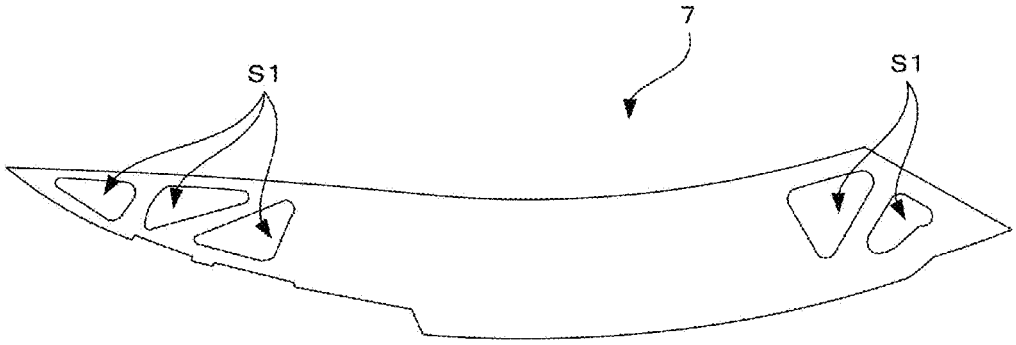
FIG. 11 is a diagram showing a rib according to still another variation.

In the above embodiment, openings S1 are not formed in the end portion 7*b* on the toe side of the rib 7, in which the height is low, due to difficulty in formation, but the openings S1 can be formed over the entirety of the rib 7. Also, even in the case of forming openings S1 in only a portion of the rib 7, as shown in FIG. 11 for example, the openings S1 can be formed in a portion different from that in the above embodiment of the rib 7.

Normally, in a primary natural frequency mode, it is often the case that the vicinity of the center of the sole surface is the anti-node of the vibration, and the vicinity of the outer periphery of the sole surface is the node of the vibration, and an improvement in rigidity by the rib 7 is needed more in the vicinity of the anti-node of the vibration. Accordingly, as shown in FIG. 11, the rib 7 can be constituted without the openings S1 formed therein in the vicinity of the anti-node of the vibration of the head body 6. Specifically, when forming the openings S1 in the rib 7, the rigidity improving effect of the rib 7 may slightly be decreased in the vicinity of the openings S1. Accordingly, it can be said to be preferable that the openings S1 are formed in the vicinity of the nodes of the vibration, which are the portions in which it is relatively non-problematic even if the rigidity improving effect of the rib 7 decreases. Of course, openings S1 may be formed at both the anti-node and the nodes of the vibration, but rigidity can be effectively maintained if no or few openings S1 are formed in the vicinity of the anti-node of the vibration, and the openings S1 are concentrated in the vicinity of the nodes of the vibration.

3-6

The openings S1 formed in the rib 7 can be through-holes as in the above embodiment, or can be openings that have bottoms. Also, through-holes and openings that have bottoms can be used in combination.

Working Examples

The following describes working examples of the present invention. Note that the present invention is not limited to the following working examples.

Figure 12A:
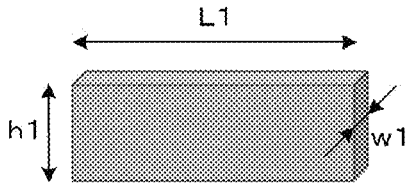
FIGS. 12A to 12E are diagrams showing thin-plate members (ribs) according to working examples and comparative examples.
Figure 12B:
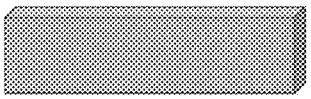

As a first comparative example, the rib was a thin-plate member simply having no openings (see FIG. 12A), and the second moment of area in the lengthwise direction was calculated. Also, as a second comparative example, the rib was a thin-plate member having no openings and having a lower height h1 than that in the first comparative example (see FIG. 12B), and the second moment of area in the lengthwise direction was calculated.

Figure 12C:
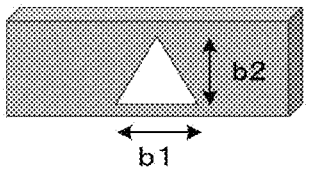
Figure 12D:
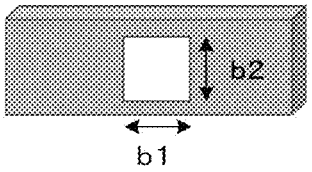
Figure 12E:
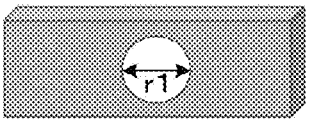

Also, as a first working example, the rib was a thin-plate member having an equilateral triangular opening (through-hole) (see FIG. 12C); as a second working example, the rib was a thin-plate member having a square opening (through-hole) (see FIG. 12D); and as a third working example, the rib was a thin-plate member having a circular opening (through-hole) (see FIG. 12E). The second moment of area in the lengthwise direction was calculated for these ribs.

Table 1 below shows the dimensions (length L1, thickness w1, and height h1) of the thin-plate members of the above comparative examples and working examples. Table 1 below also shows the dimensions (bottom side b1, height b2, and diameter r1) of the openings in the thin-plate members of the working examples. Specifically, the thin-plate members of the first to third working examples were obtained by forming openings in thin-plate members of the same shape and same material as the thin-plate member of the first comparative example, and although the shapes of the openings are different, the volumes of the openings are the same. Also, the thin-plate member of the second comparative example has the same dimensions as the thin-plate members of the first comparative example and the first to third working examples, with the exception of the height h1. Also, the volume occupied by the thin-plate member of the second comparative example and the volumes occupied by the thin-plate members of the first to third working examples are all the same. Accordingly, the effects of reducing the weight (volume) in the cases of using the thin-plate members of the second comparative example and the first to third working examples as the rib 7 in the above embodiment are the same, with respect to the case of using the thin-plate member of the first comparative example.

Table 1 shows calculations of rib rigidity ratios as percentages of the second moments of area of the second comparative example and the first to third working examples with respect to the second moment of area of the first comparative example. Note that the second moments of area calculated here were values obtained by the second moments of area of cross-sections perpendicular to the lengthwise direction of the thin-plate member being integrated from one end to the other end along the lengthwise direction.

The second moment of area is an index representing the rigidity of an object, and as can be understood from Table 1, the extent to which a reduction in rigidity could be prevented (rib rigidity ratio) in the case of reducing the weight (volume) by the same amount with respect to the first comparative example was highest in the first working example (equilateral triangular shape) and decreased in the order of the second working example (square shape), the third working example (circular shape), and then the second comparative example (no opening, low height). In other words, it is understood that providing openings in the rib 7 of the above embodiment makes it possible to achieve weight reduction while also efficiently maintaining rigidity. Also, from the viewpoint of improving rigidity and weight reduction, it is understood that a polygon is superior as the shape of the openings, and a triangle is particularly superior.

REFERENCE SIGNS LIST

1 Face portion
2 Crown portion
3 Sole portion
4 Side portion

TABLE 1

| | Work. Ex. 3 Circular hole | Work. Ex. 2 Square hole | Work. Ex. 1 Equilateral triangular hole | Comp. Ex. 2 Rib with low height and no opening | Comp. Ex. 1 Rib with no opening |
|---|---|---|---|---|---|
| Rib length L1 [mm] | 60 | 60 | 60 | 60 | 60 |
| Rib thickness w1 [mm] | 1 | 1 | 1 | 1 | 1 |
| Rib height h1 [mm] | 6 | 6 | 6 | 5.79 | 6 |
| Opening maximum width b1 [mm] | — | 3.54 | 5.39 | — | — |
| Opening maximum height b2 [mm] | — | 3.54 | 4.67 | — | — |
| Opening diameter r1 [mm] | 4 | — | — | — | — |
| Opening area [$mm^2$] | 12.6 | 12.6 | 12.6 | 0.0 | 0.0 |
| Rib rigidity ratio | 97.91% | 98.78% | 99.30% | 89.89% | 100.00% |
| Rib specific rigidity ratio (rib specific rigidity = rib rigidity/rib weight) | 101.46% | 102.36% | 102.90% | 93.15% | 100.00% |

6 Head body

7 Rib

7*b* End portion on toe side

7*c* Portion other than end portion on toe side

100 Golf club head

S1 Opening

The invention claimed is:

1. A golf club head comprising:

a head body that is a hollow structure; and a rib that rises from first inner surface of the head body and does not reach a second inner surface of the head body, the second inner surface opposing the first inner surface, wherein an opening having a non-circular shape is formed in a side surface of the rib.

2. The golf club head according to claim 1, wherein the opening has a polygonal shape.

3. The golf club head according to claim 2, wherein the opening has a triangular shape.

4. The golf club head according to claim 1, wherein a plurality of openings are formed in the side surface of the rib.

5. The golf club head according to claim 3, wherein a plurality of openings having a triangular shape are formed in the side surface of the rib, the plurality of openings being aligned in a mode in which the rib at least partially forms a truss structure.

6. The golf club head according to claim 1, wherein the rib and at least a portion of the head body are formed integrally.

7. The golf club head according to claim 1, wherein the rib is manufactured separately from the head body and thereafter fixedly attached to at least a portion of the head body.

8. The golf club head according to claim 1, wherein the volume occupied by the opening is in a range of 10% to 70% of the volume occupied by the rib.

9. The golf club head according to claim 1, wherein the head body has a sole portion, and the rib is formed on at least an inner surface of the sole portion.

10. The golf club head according to claim 1, wherein the head body has a crown portion, and the rib is formed on at least an inner surface of the crown portion.

11. The golf club head according to claim 1, wherein the head body has a face portion, and the rib is formed on at least an inner surface of the face portion.

12. The golf club head according to claim 1, wherein the opening is formed on the side surface of the rib in a vicinity of a node of vibration of the head body.

13. The golf club head according to claim 1, wherein the golf club head is a driver.

14. The golf club head according to claim 1, wherein a height of the rib at the highest point is 3 mm to 10 mm.

15. The golf club head according to claim 1, wherein said opening has a quadrangular shape.

16. The golf club head according to claim 1, wherein said opening has a square shape.

* * * * *